US008418754B2

(12) United States Patent
Ahern, Jr.

(10) Patent No.: US 8,418,754 B2
(45) **Date of Patent: *Apr. 16, 2013**

(54) EMERGENCY WATER PUMP SYSTEM

(76) Inventor: Richard D. Ahern, Jr., Sterling, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/349,941

(22) Filed: Jan. 13, 2012

(65) Prior Publication Data

US 2012/0152520 A1 Jun. 21, 2012

Related U.S. Application Data

(63) Continuation-in-part of application No. 12/940,485, filed on Nov. 5, 2010.

(60) Provisional application No. 61/350,810, filed on Jun. 2, 2010.

(51) Int. Cl.
*E21B 43/00* (2006.01)

(52) U.S. Cl.
USPC ..... 166/68; 166/105

(58) Field of Classification Search ..... 166/369, 166/68, 68.5, 105
See application file for complete search history.

(56) References Cited

U.S. PATENT DOCUMENTS

| | | | | |
|---|---|---|---|---|
| 987,475 | A | 3/1911 | Martin | |
| 1,279,580 | A | 9/1918 | Peters | |
| 1,517,665 | A | 12/1924 | Chase | |
| 2,552,762 | A | 5/1951 | Baker | |
| 2,553,276 | A | 5/1951 | Reed | |
| 3,367,281 | A | 2/1968 | Gray | |
| 3,930,754 | A | 1/1976 | Mogg et al. | |
| 3,975,115 | A | 8/1976 | Fisher et al. | |
| 4,579,511 | A | 4/1986 | Burns | |
| 4,802,829 | A | 2/1989 | Miller | |
| 5,772,405 | A | 6/1998 | Eller | |
| 6,210,125 | B1 | 4/2001 | Eller et al. | |
| 6,413,053 | B1 | 7/2002 | Bevington | |
| 6,435,838 | B1 | 8/2002 | Marvel et al. | |
| 2011/0198275 | A1 * | 8/2011 | Hayes | 210/251 |

FOREIGN PATENT DOCUMENTS

| | | | |
|---|---|---|---|
| AU | 200143796 | A1 | 11/2001 |
| JP | 9248558 | A | 9/1997 |

* cited by examiner

*Primary Examiner* — William P Neuder

(74) *Attorney, Agent, or Firm* — Barlow, Josephs & Holmes, Ltd.

(57) ABSTRACT

The invention is generally directed to the novel and unique water pump system that is for manual operation, such as when there is a power failure and electrical pump systems are inoperable. When air is delivered into the air input port of the air line conduit, the air pushes water residing in the static chamber and water conduit up through the main water line and into an optional expansion tank for use. An electrical air compressor may be used to deliver the air. The water pump system may be provided in a parallel configuration for continuous operation and also in a stacked series configuration for deep well environments.

15 Claims, 5 Drawing Sheets

EMERGENCY WATER PUMP SYSTEM

CROSS REFERENCE TO RELATED APPLICATION

This application is a continuation-in-part of, is related to and claims priority from earlier filed U.S. Ser. No. 12/940,485, filed Nov. 5, 2010, which is related to and claims priority from earlier filed provisional patent application Ser. No. 61/350,810, filed Jun. 2, 2010, the entire contents thereof is incorporated herein by reference.

BACKGROUND OF THE INVENTION

The invention relates generally to water pump systems. More specifically, the present invention relates to water well pump systems, such as those that are employed for pumping water from an underground well up to a house or other location for use of that water for drinking, showering, restrooms cooking and the like.

Water pumps are very well known in the prior art. In particular pumps are very well known for pumping water from an underground well. There are two primary types of pumps that are known for pumping such water from an underground well. First, a manual crank style manual pumping system is very well known whereby a dedicated well is provided that receives a pipe therein. A piston type manual pump with an integral flapper valve is placed in fluid communication with the pipe whereby a up stroke of the piston pulls water upwardly from the well using a vacuum while a down stroke allows the air to pass through the valve. Further discussion of these manual pumping systems is not needed, as these systems are very old and exceedingly well known.

Another common system for pumping water from a well is an electrical pump. In this system, an electrically powered pump is submerged down in the well and is interconnected to a water conduit for delivery water back up to the plumbing of the house. Various types and configurations of such electrical pumps are available. In modern homes, such electrical pumps are used as they provide the convenience of water delivery to the desired location. The common feature of these pumps is that they all required electricity to operate.

Although very convenient, the foregoing electrical pump systems suffer from the disadvantage that they will not operate without electricity, either in the form of electricity from the local utility company or from a back power source, such as a generator. If there is a power failure, the well water pump simply will not operate and the water in the home will be depleted when all of the pipes, expansion tanks and other storage locations are emptied. This is very problematic when a home that does not have a back up generator experiences a power outage because it is very disruptive. Furthermore, even if a home has a backup generator, it will only operate as long as it has enough fuel. Once that fuel is depleted, the electrical water pump will also cease to operate.

In view of the foregoing, there is a demand for an emergency manual pump system that can pump water when no electricity is available to operate an electrical well water pump.

There is a further demand for an emergency manual pump system that can be easily incorporated into an existing well water delivery system and home plumbing.

There is a demand for an emergency manual pump system that does not require a separate dedicated well for pumping when no electricity is available and the electrical well water pump is not operational.

SUMMARY OF THE INVENTION

The present invention preserves the advantages of prior art well water pump systems. In addition, it provides new advantages not found in currently available well water pump systems and overcomes many disadvantages of such currently available—systems.

The invention is generally directed to the novel and unique water pump system that is for manual operation, such as when there is a power failure and electrical pump systems are inoperable. The present invention addresses the shortcoming of prior art systems by providing an emergency manual pump system that can easily retrofit to an existing well that has water residing therein that has a static level. A water conduit, that has a first end and a second end, is provided. An expansion tank is connected to the first end of the water conduit, which runs from below the static water level of the water to the expansion tank. Also provided is a static chamber, which has a top and a bottom portion, and is disposed in the well and below the static water level.

A number of valves are provided to control flow of water in the system of the present invention. A first one way valve is fluidly connected to the bottom portion of the static chamber to permit upward flow of water residing in the well to enter the static chamber. A second one-way valve is fluidly connected to the top portion of the static chamber to permit downward flow of air into the static chamber. A portion between the first one way valve and the second one way valve, the static water chamber is fluidly connected to the water conduit above the electrical pump. A third one way valve is disposed below the connection of the static chamber to the water conduit and a fourth one way valve disposed above the connection of the static chamber to the water conduit.

Still further, an air line conduit is included with a first end and a second end. The first end of the air line conduit is fluidly connected to the top portion of the static chamber with the second end of the air line conduit being an air input port. When air is delivered into the air input port of the air line conduit, such as by a manually-actuated pump, the air pushes water residing in the static chamber and water conduit up into an expansion tank for use.

Also, it possible to modify the system to meet the needs of the user and the purposes and environment of the pump system of the present invention. For example, the system of the present invention can be modified to provide air into the air line conduit to push the air by a battery-powered electrical air compressor. Optionally, a solar panel may be electrically interconnected to the battery to recharge it. As a result, air may be provided by an electrical pump to facilitate use by the user.

Further, a booster pump may be provided in-line with the water supply conduit to the expansion tank. A booster pump, such as 12 volt pump that runs on a battery in similar fashion to the electrical air pump above, is used to better control, such as raise, the water pressure of the flow of water to the expansion tank. A bypass around the booster pump is optionally provided in case the booster pump fails. Thus, the booster pump improves overall performance of the system of the present invention.

The system of the present invention may also be provided in a parallel configuration so continuous flow of water can be easily achieved. In this configuration, one pump unit of the unit of the system may be providing a pumping operation while the one or more other pump units are re-charging. Cycling of pumping is timed for continuous operation.

In yet another embodiment of the present invention, a stacked series configuration is provided. In this configuration, multiple pump units are provided in series to move a column of water in stages. This stacked configuration has particular utility in deep well applications. Also, continuous operation can be achieved by initiating charging of the lowermost pump unit when it has been isolated even when a column of water is moving through pump units higher up in the stacked series array.

It is therefore an object of the present invention to provide an emergency well water backup pump system.

A further object of the present invention is to provide a backup secondary manual pump system that integrates directly into an existing electrical well water pump system with very few changes to the existing system.

There is an object of the present invention to provide a system that is easy to operate and is sufficient for providing emergency delivery of water for essential water needs, such as drinking, cooking, showering, restroom use, and the like.

Another object of the invention is to provide an emergency well water backup system that includes battery-powered auxiliary air delivery and water pumping for improved operation.

A further objection of the present invention is to provide a well water backup system with a parallel configuration for continuous pumping operation.

Yet another object of the present invention is to provide a well water backup system with a stacked series configuration to facilitate pumping water in deep well environments.

BRIEF DESCRIPTION OF THE DRAWINGS

The novel features which are characteristic of the present invention are set forth in the appended claims. However, the invention's preferred embodiments, together with further objects and attendant advantages, will be best understood by reference to the following detailed description taken in connection with the accompanying drawings in which:

DETAILED DESCRIPTION OF THE PREFERRED EMBODIMENT

Figure 1:
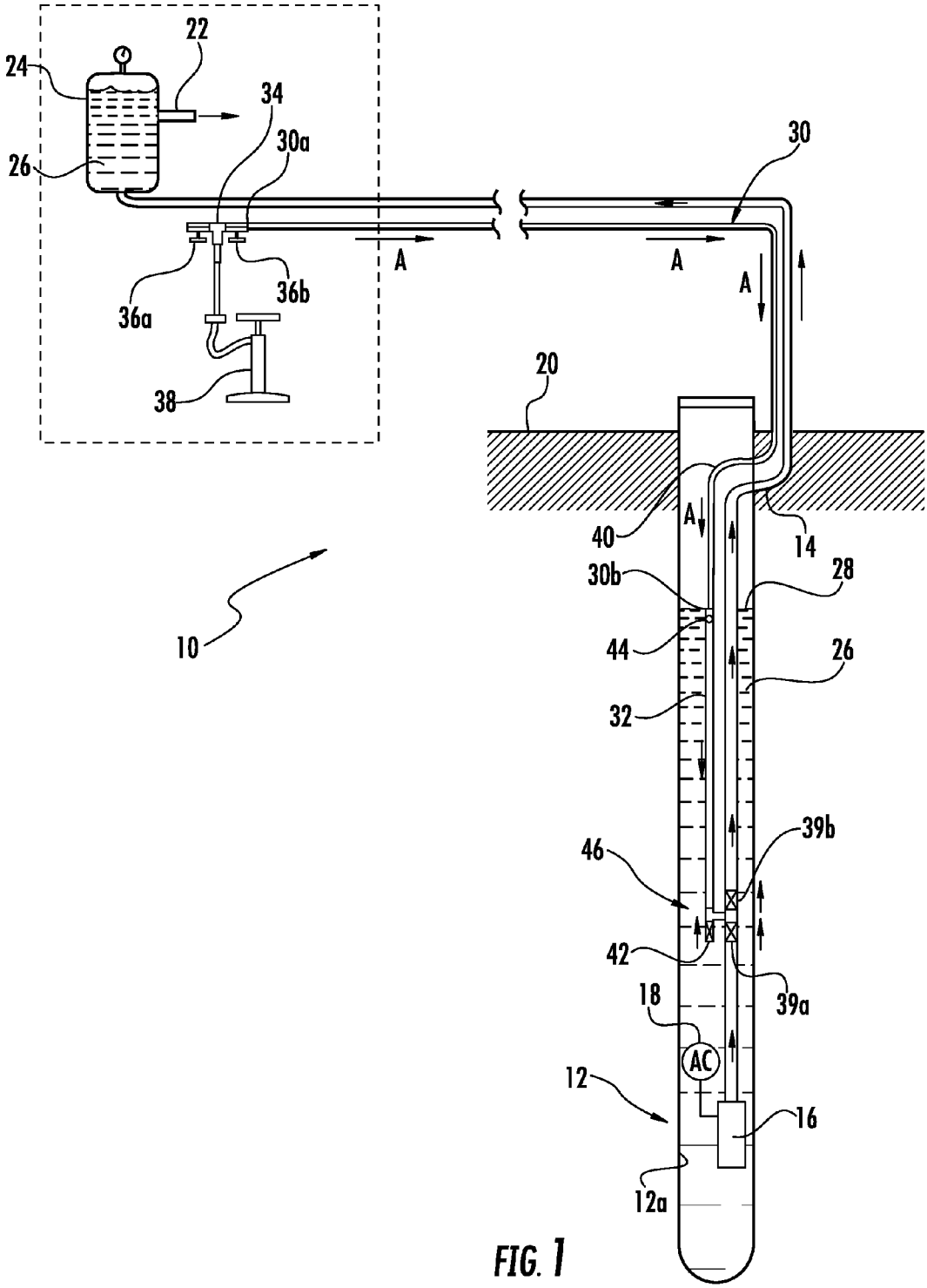
FIG. 1 is a cross-sectional view of the emergency water pump system of the present invention.
Figure 2:
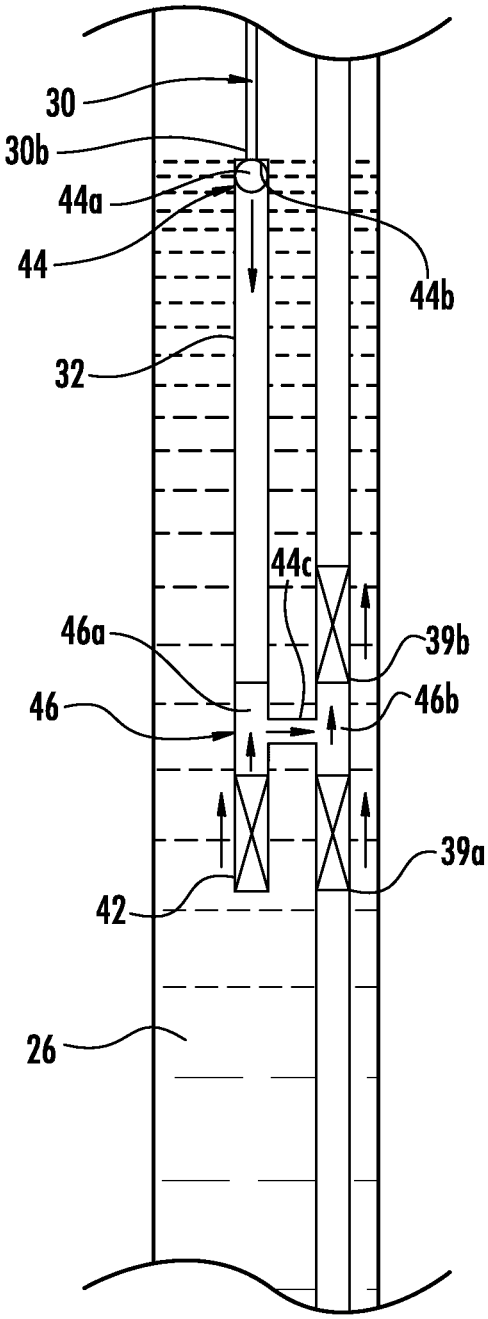
FIG. 2 is a close-up cross-sectional view of well region of the water pump system of the present invention.

The invention is generally directed to the novel and unique emergency well water pump system 10. The system 10 of the present invention is shown in the attached FIGS. 1 and 2. Turning first to FIG. 1 a side cross-sectional view of the invention is shown while FIG. 2 shows a close view of the portion of the system in the region of the well.

FIG. 1 shows the construction and configuration of the system 10 of the present invention. The typical installation and use of the present invention is for retrofitting into an existing well, generally referred to as 12, that has already be dug with the existing water line 14 and electrical pump 16 used therewith. The electrical pump is powered by AC power 18, for example, but could also be DC power. However, it is possible to use the system 10 of the present invention with a completely new installation. Therefore, the present invention is suitable for use in both situations.

Generally, a well 12 is shown that is positioned into and below the ground 20. A well 12 of this nature is commonly 6 inches in diameter. Wells can extend any distance below the ground surface 20 and can even extend to hundreds of feet below the surface 20. It is not uncommon for a home water well 12 to extend more than 200 feet below the ground surface 20. It is preferred that an electrically powered well pump 16 be provided proximal to the bottom of the well 12 with a water line 14, which may be 1 inch in diameter that interconnects to the plumbing of the home 22 via an expansion tank 24. As is well known in the art, water 26 in the well 12 is located up to a static water line 28 with the electric pump 16 located therebelow. When water 26 is needed, the electrical pump 16 turns on, using electricity, to pump water 26 upwardly through the water line 14 for use. Commonly, the water line 14 feeds the water 26 first into an expansion tank 24. This expansion tank 24, as shown in FIG. 1, is typically positioned between the water line 14 and the house plumbing 22. Expansion tanks 24 are commonly of a size in the range of 20-44 gallons. The foregoing components and general construction is a common system for homes with a well 12 and a well water pump 16. Such construction and systems are so well in the art that they need not be discussed in further detail herein.

However, it is well known that if the electrically powered pump 16 fails in such a construction and system, it will no longer be able to pump further water 26 from within the well 12 up into the expansion tank 24. Therefore, after the remaining water 26 in the expansion tank 24 is used, the house plumbing 22 will go dry and no water 26 from the well 12 will be accessible or usable, even though the well 12 is full of water 26. In the prior art, it is common for the homeowner to store sealed containers of water so that they can fill and re-file toilets and other basic necessities even after the expansion tank 24 is emptied. Such water storage is necessary if the homeowner wants some water during a power outage despite the presence of gallons and gallons of water in their own well 12. Therefore, there is a need for the homeowner to be able to get that water 26 out of their existing well 12 using a system that does not use any electrical power 18.

As can be seen in the drawings figures, applicant's invention provides a parallel secondary air line 30 and static chamber 32 that can be easily retrofitted to be positioned next to the water line 14. Still referring to FIG. 1, the general construction of the system 10 of the present invention uniquely includes a special air line 30, such as ⅜ inch to ½ inch in diameter, that runs from, preferably, inside the house (not shown) and then down into the well 12 cavity. The aforementioned dimensions are by way of example only and the air line 30 can be of any desired sized, depending on the size of the well 12 and desired control of the water flow.

The air line 30 preferably runs next to the water line 14 down to just above the well 12 pump. The air line 30 and water line 14 are both small enough in diameter to both easily fit within an existing well 12 and are dimensioned accordingly. For example, a one inch water line 14 and a ½ inch air line 30 can easily fit within a 6 inch diameter well cavity.

The air line 30, preferably in the form of a tubular conduit, has a upper free end **30*a* and a lower free end 30*b*. An air fitting 34 is preferably provided on the upper free end 30*a* of the air line 30 that is located above ground 20. This fitting 34 is preferably located inside the house or building for easy access by the owner. For example, a pair of valves 36*a* and 36*b* is preferably provided to control air flow into the free end 30*a* of the air line 30 and downwardly through the air line 30. A "T" connection 34 is thereby preferably provided with valves 30***a* and 30*b* on either side for full control of air flow at the juncture. While this configuration is preferred, other configurations of valves can be provided and still be within the scope of the present invention.

A manual pump 38, such as a bicycle or foot pump, is connected to the air fitting 34 so that air may be manually pumped into the air line 30 and then down through a second, lower free end 30*b* of the air line 30, which is located at the bottom of the well 12. In this case, the left air valve 36*a* remains closed and the right air valve 36*b* remains opened so that air flows in the direction of the arrows A.

Figure 3:
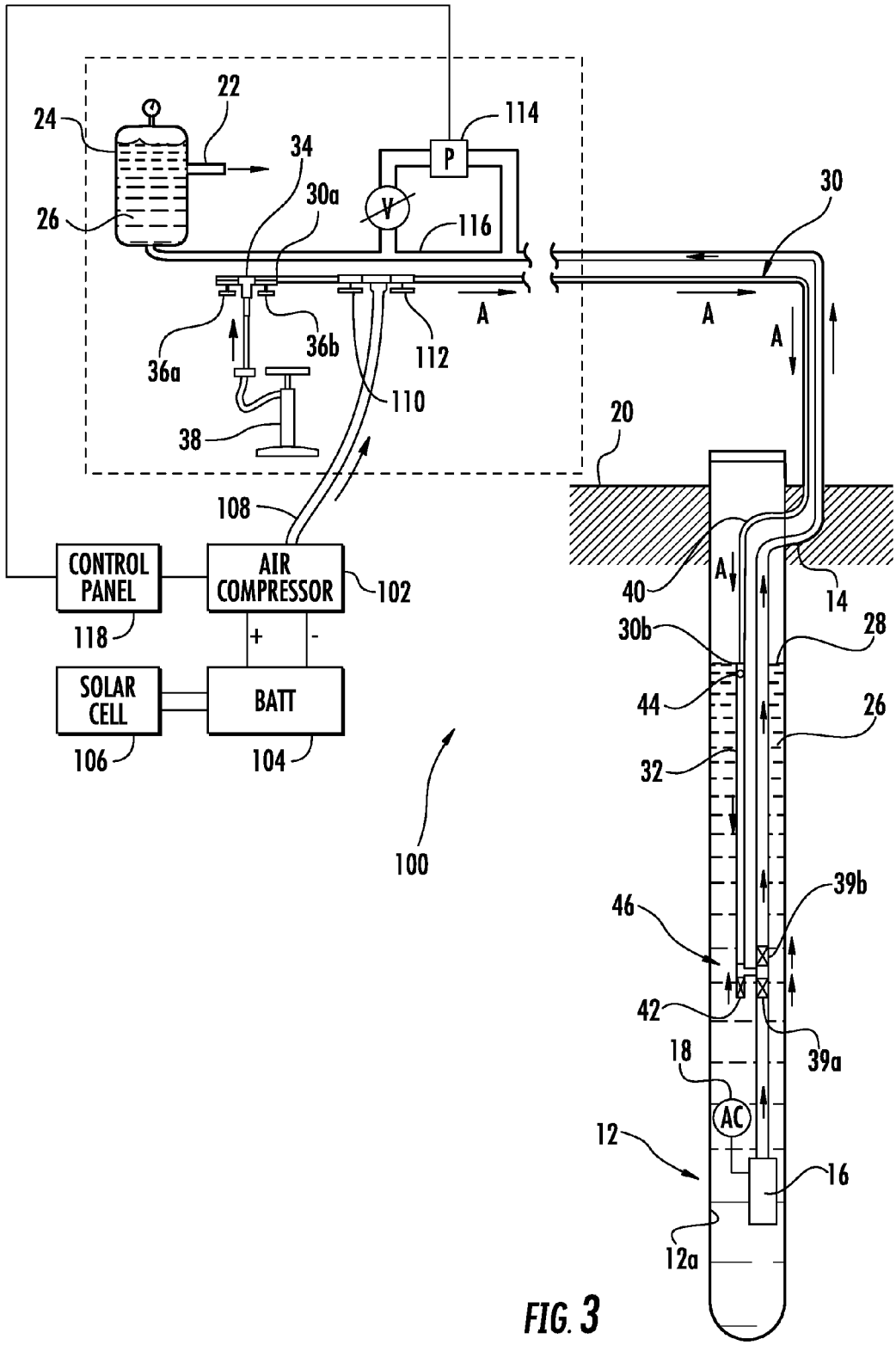
FIG. 3 is a cross-sectional view of an alternative embodiment of the emergency water pump system of the present invention.

As seen in FIG. 3, a first alternative embodiment 100 is shown. An electrically powered air supply 102 can be used instead of the manual pump 38 seen in FIG. 1. The powered air supply 102 is preferably an electrically powered air compressor, such as one that runs on 12 volts to facilitate powering by a 12 volt battery 104. It is also possible that the battery electrical power source is rechargeable for ease of operation. For example, a solar panel 106 is preferably electrically interconnected to the battery 104 to recharge it. As a result, the battery 104 can better provide electricity to power the air compressor 102.

The electrical air compressor 102 includes a compressor air line 108 that is fluidly interconnected to the air line 30 to supply air to the static water chamber 32. Valves 110 and 112 on opposing sides of the compressor air line 108 isolate the manual pump 38 or the electrical air compressor 102 to determine which one will be providing air into the static water chamber 32 via air line 30.

As will be described in detail below, a series of water check valves 39*a* and 39*b* control the flow of water 26 in the system 10 of the present invention to ensure that water 26 flows only in one direction, namely up through the water line 14. The manual pump 38 (or electrical air compressor 102) is preferably interconnected to the air fitting 34 in the house to push air into the air line 30 to, in turn, push water 26 that is below the waterline 28 in the well 12 down and then up through the water line 14 and into the expansion tank 24 back up in the house. The fitting 34 may include a threaded bicycle nozzle (not shown). As a result, the water 26 in the expansion tank 24 can then be used as needed via the house plumbing 22, as explained above. Thus, when there is a power outage, a simple manual pump 38 can be connected to the air fitting 34 to push water 26 up from the reservoir of water 26 in the well 12 back up into the expansion tank 24 for use. When all of the water 26 in the expansion tank 24 is used up, the manual pump 38 can be used again to fill up the expansion tank 24 again. This can be repeated indefinitely.

Details of the movement of the pumped air and the control of the water flow are outlined in detail in FIG. 2. Such movement of the air and water 26, with the assistance of only a small manual pump 38 is a new and novel aspect of the present invention. A static chamber 32 is located in the well cavity 12*a* and adjacent to the water line 14 that runs from the water pump 16 up to the expansion tank 24 and then to the house plumbing 22. The static chamber 32 is a tubular member preferably 1 inch to 2 inches in diameter, but can be any size to suit the size of the installation. The air line 30 delivers air 40, via a simple manual pump 38 into the static chamber 32. The static chamber 32 is located below the static water line 28 of the well 12 so that it will always be charged with water 26. As needed, check valve 42 permits water to continuously refill the static chamber 32 from below. A ball check valve 44 located at the top of the static chamber 32 prevents water 26 from travelling up through the air line 30 and back up to the house. It also prevents air 40 from travelling in the reverse direction up the air line 30 to the house when water 26 in the static chamber 32 is being pushed into the water line 14 and up into the expansion tank 24.

At the bottom portion of the static chamber 32, an H-connector (two T-connectors back to back) 46 is preferably provided just above the lower one way check valve 42 that lets water 26 into the static chamber 26, as needed, from the reservoir of water 26 in the well 12. When air 40 is pushed downwardly through the air line 30, the ball (float) valve 44 opens by the ball 44*a* lifting downwardly off the top surface 44*b* of the static chamber 32 and then the water 26 residing in the static air chamber 32 is pushed downwardly. When the static water level 28 rises above the top of the static chamber 32, the ball (float) valve 44 seals the air line 30 from the static chamber 32. As the static water level 28 drops below the top of the static chamber 32, the ball 44*a* of the float valve 44 floats down with the static level 28 of the water 26 and will even descend to the bottom if the water 26 drops that low. Since the lower valve 42 in the static chamber 32 is one way in the upwards direction, the water 26 in the static chamber 32 travels through a left T-connector 46*a* and over to the water line via another (right) T-connector 46*b*. Another one way check valve 39*a* is located below the T-connector 46*b* in main line and further one way check valve 39*b* is provided above the T-connector 46*b* in the main line 14. This allows for water 26 to flow only upwardly toward the expansion tank 24 and not downwardly toward the electrical pump 16.

In operation, the manual pump 38 is attached to the air fitting 34 attached to the open end 30*a* of the air line 30 in the house. The left air valve 36*a* is closed and the right valve 36*b* is opened to ensure that air 40 from the manual pump 38 travels down towards the static chamber 32. Thus, manual pumping of air 40 delivers air 40 through the air line 30 and through the ball check valve 44 at the top of the static chamber 32. Continued pumping of air 40 from the manual pump 38 pushes water 26 present in the static water chamber 32 down and out of the static chamber via a cross conduit 46*c*, that attaches the two T-connectors 46*a* and 46*b* together, and then into the water line 14 and then up through the upper check valve 39*b* in the water line 14. The lower water valve 39*a* on the water line 14 prevents water 26 from travelling downwardly towards the electrical pump 16. The upper water valve 39*b* permits upward travel of water 26 through the water line 14. Continued pumping of air 40 causes the water 26 present in the static chamber 32 and the water line 14 to travel above the water line 28 and up into the expansion tank 24 in the house for use via plumbing 22. The expansion tank 24 can be filled to any desired pressure, such as 40-60 psi. It should be noted that the water line 14 and static chamber 32 are preferably of a tubular construction, such as a hose, so that it is common that the length of such water line 14 and static chamber 32 have a volume large enough to contain enough water 26 to easily fill an expansion tank 24 in a house. When the expansion tank 24 is empty, the manual pumping operation can be repeated.

As seen in FIG. 3, the pumping of water 26 into the expansion tank 24 can be improved by employing an electrical booster pump 114 in line with the water line 14. The booster pump 114 preferably runs on 12 volt DC to facilitate electrical interconnection to a battery 104, which could be similar to the battery 104 used for the air compressor 102 or the same battery 104. A bypass line 116 is preferably provided in parallel with the booster pump 114 in case the booster pump 114 fails. The booster pump 114 is preferably used in an automated fully powered system to provide a desired 50 lbs. of back pressure of water in the expansion tank 24. For example, the booster pump 114 can be wired to a control panel 118 so that when the air compressor 102 turns on, the booster pump 114 also turns on. This booster pump 114 helps or supplements the pushing of water to better pressurize the expansion tank 24.

Most notably, the configuration of the system 10 of the present invention allows for the electrical pump 16 to seamlessly resume operation when electrical service 18 returns. When the electrical pump 16 becomes operational later, due to the resumption of electrical service 18, the electrical pump 16 will pump water 26 upwardly through the pair of check valves 39*a* and 39*b*, namely through the lower water valve 39*a* then through the upper water valve 39*b* in the main line 14. Water 26 is prevented from flowing into the static chamber 32 at this point due to the presence of the ball check valve 44 at the top of the static chamber 32 and water 26 being present in the static chamber 32 and downward movement of water 26 out of the static chamber 32 will be prevented by the valve 42 at the bottom of the static chamber 32.

The use of check valves is preferred for the water valves, however, any type of valve may be used for the present invention depending on the particular installation. The valve 44 at the top of the static chamber 32 is preferably a ball check valve, however, any type of valve suitable for this purpose can be used. Also, the air control valves 36*a*, 36*b* at the input port 30*a* of the air line 30 can be any type of valve that can control the flow of air 40 in the air line 30. Also, the dimensions of the main line 14, air line 30 and static chamber 32 can be modified to suit the size and needs of the installation at hand. The air line 30 and static chamber 32 can be made out of any type of material. For example, the air line 30 and the static chamber 32 can be made out of any suitable water line material, such as plastic tubing, hose or pipe.

Therefore, in accordance with the present invention, a manual pump system 10 is provided that can easily retrofit to an existing electrically powered pump well system in the event the electrical pump 16 fails. Air 40 can be manually pumped during a power outage so that the water 26 present in the well 12 can be used. Upon return of electrical service 18, use of the well 12 via the electrical pump 16 with normal operation can resume seamlessly.

As above, the invention provides for a single pumping unit with a single static water chamber 32 and set of associated water lines and air lines. However, it is possible to provide various configurations that employ two or more pumping units that work together for enhanced operation.

Figure 4:
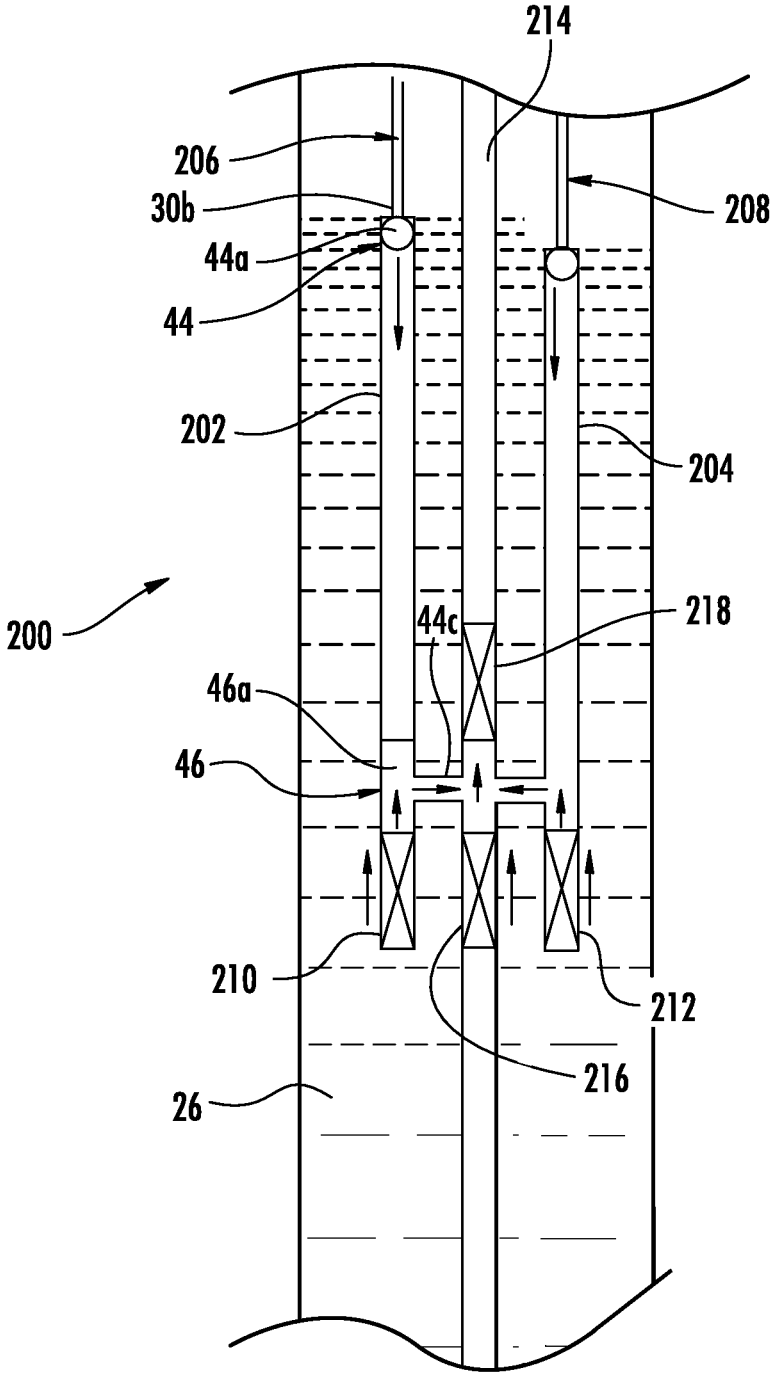
FIG. 4 is a close-up cross-sectional view of the well region of an alternative embodiment of the water pump system of the present invention employing a parallel configuration.

Turning to FIG. 4, a further embodiment 200 is shown. A parallel configuration is provided where two separate static water chambers 202 and 204 are provided that work in conjunction with one another to achieve continuous pumping operation. Both sides of this parallel configuration work the same as the single pumping unit configuration shown in FIGS. 1-3 so further detailed description in this regard is unnecessary.

In general, in a dual pumping unit parallel configuration 200, such as that shown in FIG. 4, include a left static water chamber 202 and a right static water chamber 204, each with their own associated air lines 206, 208 and one way valves 210, 212 to respectively permit entry of water into the static water chambers 206, 208 to permit them to recharge. Both sides of the dual parallel system 200 of FIG. 4 share the same water return line 214, which is equipped with the usual one way valves 216, 218 for water flow control upwards to an expansion tank 24, such as that shown in FIG. 1.

In operation, the left static water chamber 202 and the right static water chamber 204 are filled and emptied for pumping in alternating fashion. For example, as the left static water chamber 202 is being filled with air to push the water into the water conduit 214, the right static water chamber 204 can be devoid of in flow of air from the air source via air line 208 to permit re-filling of the right static water chamber 204. Then, as air is being introduced into the right static water chamber 204 to evacuate the water therein to push it in to the water conduit 214, air flow in to the left static water chamber 202 is stopped to permit the left static water chamber 202 to recharge with a column of water for subsequent pumping. These conditions cycle back and forth so continuous pumping can be achieved. Control of air delivery back and forth between the left static water chamber 202 and the right static water chamber 204 is preferably assisted by some type of electronic or microprocessor control for precision operation. For the control panel 118 of FIG. 3, and its associated electronics, can be used for this purpose.

It should also be noted that more than two pumping units may be used, such as three or more. In that case, the cycling of operation is adjusted so that each pumping unit is a condition that is compatible with the other pumping units. This can be easily achieved by using the aforesaid control panel 118. While it is preferred that the pumping of air is via an electrical pump, it is also possible that the entire operation is manual where the air is re-used after the first charge.

Figure 5:
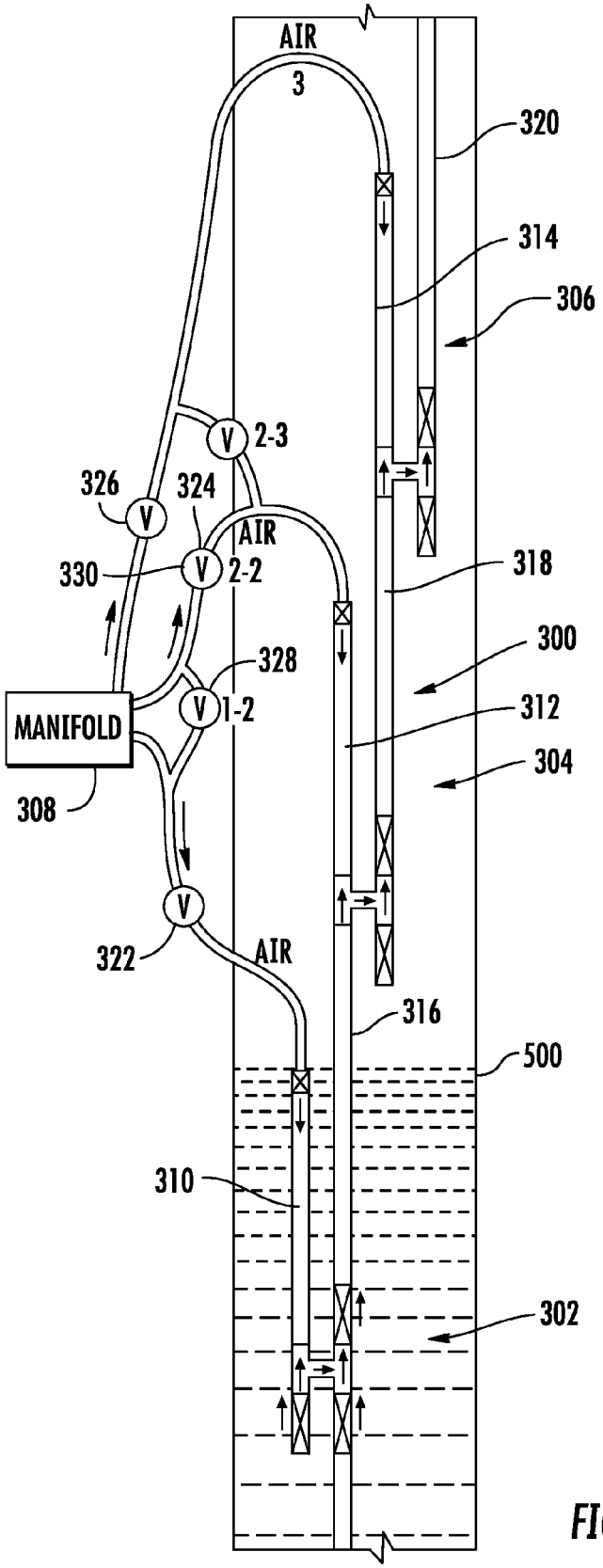
FIG. 5 is a close-up cross-sectional view of the well region of a further alternative embodiment of the water pump system of the present invention employing a stacked series configuration.

As seen in FIG. 5, yet a further embodiment 300 the present invention it shown. System 300 provides a stacked series configuration to facilitate pumping of water from deep wells. In general, each of the pumping units, generally referred to as 302, 304 and 306, act in similar fashion to the single pumping unit of FIGS. 1-2 but are provided in series with one another to move a column of water upwardly from one unit up to another. While three stages or pumping units are shown by way of example, more or less than three can be provided depending on the application at hand. The lowermost pumping unit 302 is positioned below the waterline of the well to pull water therefrom. The other pumping units 304 and 306 are in series thereabove.

Preferably an electronically controlled (such as by a control panel) air manifold 308 is provided to selectively control delivery of air into a given static water chamber 310, 312, 314. Valving 322, 324, 326 assists in the control of air delivery. First, air is delivered to the lowermost static water chamber 310 to push the water upwardly into the water line 316 and up into the second static water chamber 312. Next, air is delivered in to the middle static water chamber 312 to the column of water upwardly higher in the water line 318 between the middle static water chamber 312 and upper static water chamber 314. Then, air is delivered into the upper static water 314 chamber to push the column of water even further upwardly to the uppermost water line 320 and then, eventually, up into the expansion tank 24.

Meanwhile, valving 328 and 330 is opened to permit it to equalization between the first static water chamber 310 and the second static water chamber 312. This permits the first static water chamber 310 to fill up with water to recharge. Thus, a ladder effect of water column movement is achieved with this embodiment 300 of the present invention. It is also possible that the manifold 308 is manually controlled or that the deliver of air to each of the static water chambers 310, 312, 314 is completely manual with its own individual valves. While it is preferred that the pumping of air is via an electrical pump and valving electronically controlled, it is also possible that the entire operation is manually controlled with air being re-used after the first charge.

In view of the stacked series configuration 300 of FIG. 5, water can be lifted any amount of height, which makes is very well suited for deep well environments. The size of the pipe moving upwards can be stepped down, if desired, to increase water pressure. For example, a pump unit 302, 304, 306 can be located every 200 feet to provide segmented lifting of water in an uphill sequential progression. Continuous operation is also possible where after the lowermost static water chamber 310 has been isolated from the other chambers by use of valves, water can be permitted to refill into the lowermost static water chamber 310 while the other static water chambers 312, 314 and other pump units 304, 306 are moving another column of water upwards. Thus, while one column of water is moving upwards, another column of water can be started for pumping. It should be understood that FIG. 5 is conceptual in nature and that it is preferred that each successive stage 302, 304, 306 of pumping unit be plumbed so that they flip back and forth left to right and back for a compact structure so it can fit within a well pipe. This will allow for the diameter of the well column to be standard in size.

In view of the above, the present invention can be used as a backup pump to a standard in-well electrical water pump. Also, it is possible that the pump of the present invention can be configured as a primary pump for a house. Use as a primary pump can take advantage of all of the features mentioned above. Also, a further advantage from using the pump systems of the present invention is that there is no electrical devices or electricity in the water to further improve safety.

It would be appreciated by those skilled in the art that various changes and modifications can be made to the illustrated embodiments without departing from the spirit of the present invention. All such modifications and changes are intended to be covered by the appended claims.

What is claimed is:

1. An emergency pump system, comprising:

a water conduit having a first end and a second end;

the water conduit running from below a static water level of water in a well to above the static water level of the water in the well; the first end of the water conduit being below the static water level and the second end being above the static water level;

a static chamber;

a first one way valve fluidly connected to the static chamber to permit flow of water residing in the well to enter the static chamber;

an air line conduit having a first end and a second end; the first end of the air line conduit being fluidly connected to the static chamber; the second end of the air line conduit being an air input port; and an electric air compressor connected to the air line to deliver air into the air input port of the air line conduit to push water residing in the static chamber and water conduit through the second end of the water conduit for use.

2. The emergency pump system of claim 1, wherein electricity is provided to the electric air compressor by a battery.

3. The emergency pump system of claim 2, wherein the battery is rechargeable.

4. The emergency pump system of claim 3, further comprising a solar panel connected to the battery for recharging it.

5. An emergency pump system, comprising:

a water conduit having a first end and a second end;

the water conduit running from below a static water level of water in a well to above the static water level of the water in the well; the first end of the water conduit being below the static water level and the second end being above the static water level;

a static chamber;

a first one way valve fluidly connected to the static chamber to permit flow of water residing in the well to enter the static chamber;

an air line conduit having a first end and a second end; the first end of the air line conduit being fluidly connected to the static chamber; the second end of the air line conduit being an air input port;

an electric booster pump fluidly connected in line with the water conduit;

whereby delivering air into the air input port of the air line conduit pushes water residing in the static chamber and water conduit through the second end of the water conduit for use with the assistance of the electric booster pump.

6. The emergency pump system of claim 5, wherein electricity is provided to the electric booster pump by a battery.

7. The emergency pump system of claim 6, wherein the battery is rechargeable.

8. The emergency pump system of claim 7, further comprising a solar panel connected to the battery for recharging it.

9. An emergency pump system, comprising:

a water conduit having a first end and a second end;

the water conduit running from below a static water level of water in a well to above the static water level of the water in the well; the first end of the water conduit being below the static water level and the second end being above the static water level;

a first static chamber having a first end and a second end; the second end of the first static chamber being fluidly connected to the water conduit;

a second static chamber having a first end and a second end; the second end of the second static chamber being fluidly connected to the water conduit;

a first one way valve fluidly connected to the first static chamber to permit flow of water residing in the well to enter the first static chamber;

a second one way valve fluidly connected to the second static chamber to permit flow of water residing in the well to enter the second static chamber;

a first air line conduit having a first end and a second end; the first end of the first air line conduit being fluidly connected to the first end of the first static chamber; the second end of the first air line conduit being a first air input port;

a second air line conduit having a first end and a second end; the first end of the second air line conduit being fluidly connected to the first end of the second static chamber; the second end of the second air line conduit being a second air input port; and whereby delivering air into the first air input port of the first air line conduit and the second air input port of the second airline conduit pushes water residing in the first static chamber, second static chamber and water conduit through the second end of the water conduit for use.

10. The emergency pump system of claim 9, further comprising:

an electronically controlled air delivery manifold connected to the first air input port and the second air input port.

11. The emergency pump system of claim 9, wherein air is delivered to the first air line conduit and the second air line conduit in alternating fashion for continuous pumping operation.

12. An emergency pump system for a well with water therein, comprising:

a first static chamber residing in water in a well;

a first water conduit being fluidly connected to the first static chamber;

a first air line fluidly connected to the first static chamber;

a second static chamber residing in the water in the well; the first water conduit being fluidly connected between the first static chamber and the second static chamber;

a second water conduit being fluidly connected to the second static chamber;

a second air line fluidly connected to the second static chamber;

whereby air delivered into the first static chamber via the first air line moves water from the first static chamber to the second static chamber and air delivered into the second static chamber via the second air line moves water from the second static chamber to the second water conduit.

13. The emergency pump system of claim 12, further comprising:

a one way valve fluidly connected to the first static chamber to permit flow of water residing in the well to enter the first static chamber.

14. The emergency pump system of claim 12, further comprising:

a valve fluidly connected between the first air line and the second air line.

15. The emergency pump system of claim 12, further comprising:

a ball check valve located in both the first static chamber and the second static chamber preventing flow of water and air from the first static chamber and the second static chamber to, respectively, the first air line and the second air line.

* * * * *